US007355136B2

(12) United States Patent
Chen et al.

(10) Patent No.: US 7,355,136 B2
(45) Date of Patent: Apr. 8, 2008

(54) BUTTON DEVICE FOR COMPUTER BEZEL

(75) Inventors: Yun-Lung Chen, Tu-cheng (TW); Yi-Wen Feng, Shenzhen (CN); Yu-Ming Xiao, Shenzhen (CN); Zhou Xu, Shenzhen (CN)

(73) Assignees: Hong Fu Jin Precision Industry (Shenzhen) Co., Ltd., Bao-District, Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 312 days.

(21) Appl. No.: 11/193,909

(22) Filed: Jul. 29, 2005

(65) Prior Publication Data

US 2006/0102457 A1 May 18, 2006

(30) Foreign Application Priority Data

Nov. 13, 2004 (CN) ..... 2004 2 0095298

(51) Int. Cl.
*H01H 13/00* (2006.01)

(52) U.S. Cl. ..... 200/296; 200/341

(58) Field of Classification Search ..... 200/5 R, 200/5 A, 296, 341–345, 520; 341/22; 345/168, 345/169; 400/490–496
See application file for complete search history.

(56) References Cited

U.S. PATENT DOCUMENTS 3,657,492 A * 4/1972 Arndt et al. ..... 200/5 R
4,463,237 A * 7/1984 Kim ..... 200/345
5,817,997 A * 10/1998 Wernig ..... 200/16 R
5,957,272 A * 9/1999 Kim ..... 200/512
6,365,855 B1 * 4/2002 Sutter et al. ..... 200/314
6,492,605 B2 * 12/2002 Iida ..... 200/343
6,555,774 B1 * 4/2003 Nielsen ..... 200/343
6,667,447 B2 12/2003 Liu et al. ..... 200/5 R
6,765,164 B2 7/2004 Lee et al. ..... 200/345
7,094,983 B2 * 8/2006 Tsunemoto ..... 200/339
7,098,417 B1 * 8/2006 Fuji ..... 200/343
7,151,237 B2 * 12/2006 Mahoney et al. ..... 200/512

FOREIGN PATENT DOCUMENTS

TW 237993 1/1995

* cited by examiner

*Primary Examiner*—Michael A Friedhofer
(74) *Attorney, Agent, or Firm*—Morris Manning Martin LLP; Tim Tingkang Xia, Esq.

(57) ABSTRACT

A button device includes a base (11) mounted to a bezel (30) of an electronic device. A plurality of button units (17) are disposed in the base (11), and a plurality of through holes (13) are abreast provided in the base (11) in correspondence with the button unit (17). The button unit (17) includes a cap (18) with an elastic member (15) supported thereunder. The elastic member (15) integrally extends from the base (11) and surrounds the through hole (13). A post (19) extends from the inner bottom of the cap (18) and extends through the elastic member (15) and the through hole. In use, the post (19) gets through the hole (13) in the base (11) and touches the switch of the electronic device.

9 Claims, 5 Drawing Sheets

BUTTON DEVICE FOR COMPUTER BEZEL

BACKGROUND OF THE INVENTION

1. Field of the Invention

The present invention relates to a button device, more particularly to a button device with integrated simplified configuration.

2. Background of the Invention

As known to those who skilled in the art, a push button is often disposed on a control panel of an electronic device to control a switch behind the control panel.

For example, one conventional push button includes a button unit mounted in a seat depression of a computer bezel. A push unit passes through the seat depression and moves by a force transmitted from the button unit. The push unit includes a support part and a push part. A first spring is provided between the button unit and the support part, and a second spring is provided between the support part and the seat depression. The first and second spring is in a sealed room. When pressing the button unit, the first and second spring is compressed downwardly, and the push part is pressed to turn the switch on or off. However, in this conventional button device, the spring member and other associated members are separately installed. The assembly process is unduly complicated. Besides; the push button is stubborn to be pressed down.

Accordingly, a button device having simplified configuration which overcomes the above-mentioned problems is desired.

SUMMARY OF THE INVENTION

One embodiment, accordingly, provides a button device which includes a base fastened to a bezel of an electronic device. A plurality of button units are disposed in the base, and a plurality of through holes are abreast provided in the base in correspondence with the button units. The button unit includes a cap with an elastic member supported thereunder. The elastic member integrally extends from the base and surrounds the through hole. A post extends from the inner bottom of the cap and extends through the elastic member and the through hole. In use, the post gets through the hole in the base and touches the switch of the electronic device. All of the function members of the button device are incorporated to the base, the assembly process of the button device is simplified.

A principle advantage of this embodiment is that the button device is simply configured to cut down the cost for manufacture. Another advantage is that the button unit can be pressed to control the switch flexibly.

Other objects, advantages and novel features of the present invention will be drawn from the following detailed description of a preferred embodiment of the present invention with the attached drawings, in which:

DETAILED DESCRIPTION OF THE INVENTION

Figure 1:
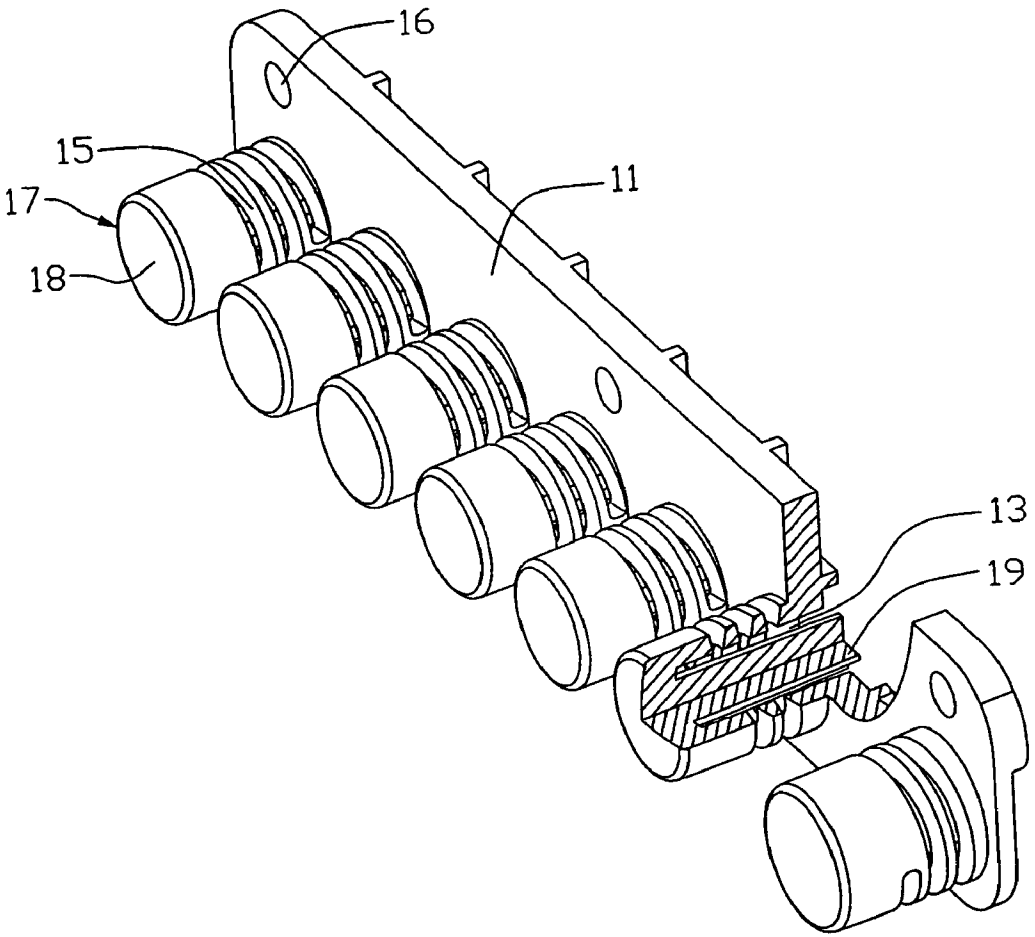
FIG. 1 is a perspective view of a button device in accordance with a preferred embodiment of the present invention.

Referring to FIG. 1, a button device in accordance with a preferred embodiment of the present invention includes a rectangular base 11 and a plurality of button units 17 disposed thereon. A plurality of through holes 13 are abreast provided in the base 11 in correspondence with the button units 17. Three securing holes 16 are defined in the base 11 beside the button units 17. A plurality of ridges are formed on the base 11 for reinforcing the base 11.

The button unit 17 has a cap 18 with an elastic member 15 supported thereunder. The elastic member 15 is a spiral extending from the base 11 and surrounding the through hole 13. It is understandable that, in this form, little stagnant air is remained in the button unit 17, so that the button unit 17 is apt to be pressed down. A post 19 extends from an inner bottom of the cap 18. The post 19 extends through the elastic member and protrudes out of the base 11 throughout the through hole 13. The base 11, the elastic member 15, the cap 18 and the post 19 are all integrally formed. In use, the post 19 gets through the hole 13 and touches the switch (not shown) of an electronic device. The post 19 works as a backward pressing part of the button unit. 17. It is appreciated for one skilled in the art that the post 19 can be various in shape.

Figure 2:
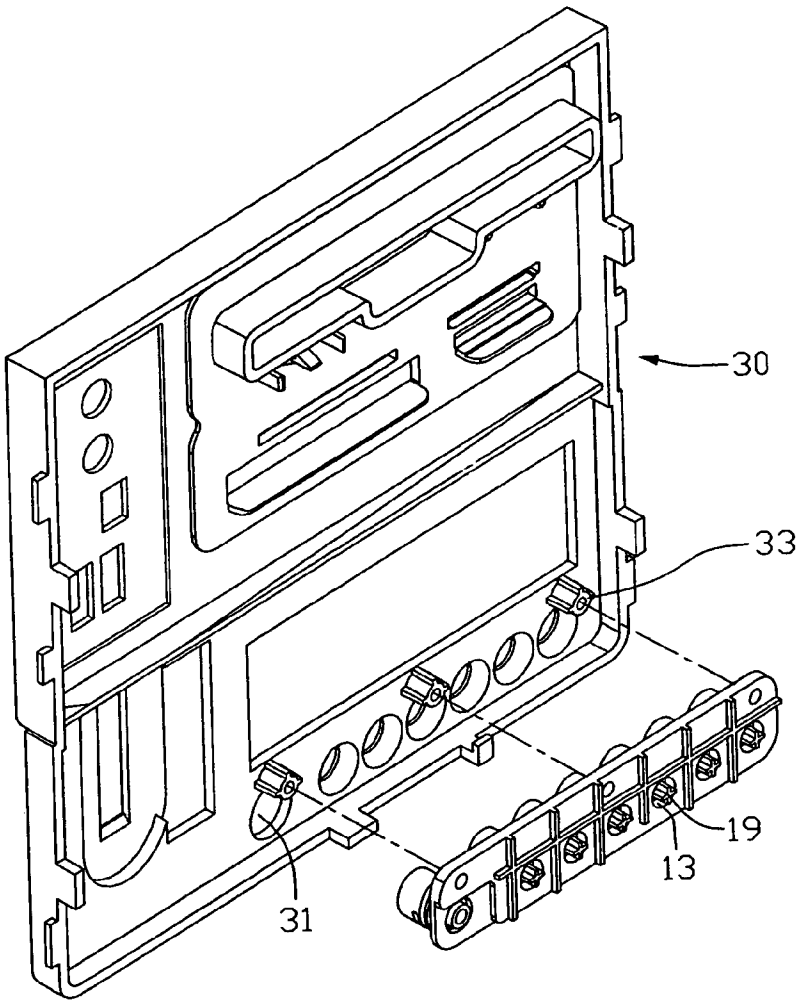
FIG. 2 is an exploded, isometric view of the button device shown in FIG. 1 with a computer bezel.
Figure 3:
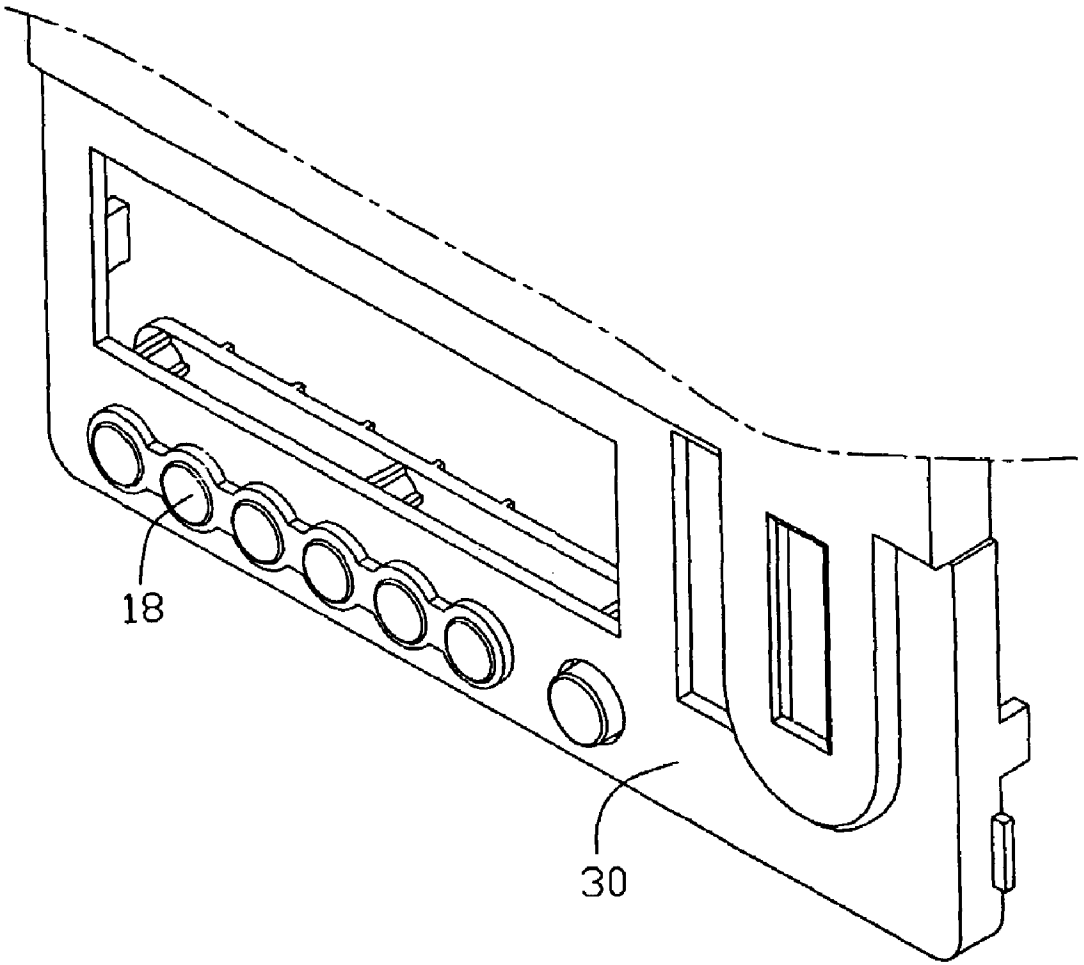
FIG. 3 is an assembled view of FIG. 2, showing the button device attached to the bezel, but viewed from another aspect.

Referring to FIGS. 2 and 3, the above mentioned button device is mounted on a bezel 30 of the electronic device. The bezel 30 defines a plurality of apertures 31 for receiving the button units 17 respectively. Three support members 33 corresponding to the securing holes 16 of the base 11 are formed on an inner side of the bezel 30. The button device is mounted to the bezel 30 with a plurality of screws (not shown) fastened in the securing holes 16 and the support members 33. Referring to FIG. 3, the button units 17 extend through the apertures 31 and available on the bezel 30. It is to be understood that, after assembly, the posts 19 are disposed before a plurality of switches (not shown) of the electronic device respectively.

In use, when the button unit 17 is pressed, force is transmitted to the switch (not shown) through the post 19. Thereby, the switch is turned on or off. The elastic member 15 is compressed downwardly. When the button unit 17 is released, the elastic member 15 rebounds back. The post 19 is retracted from the switch. The button unit 17 comes back to its original state for next operation.

Figure 4:
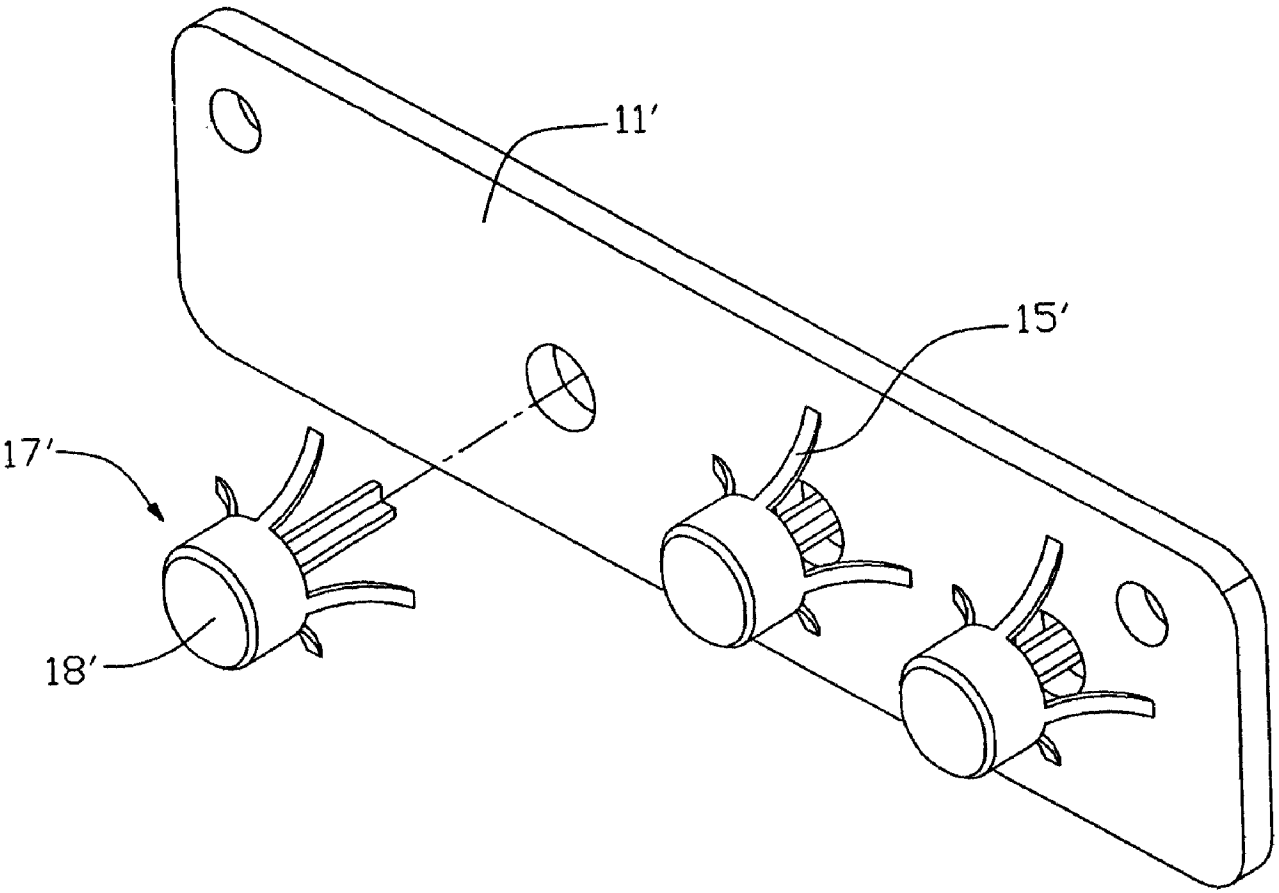
FIG. 4 is a perspective view of an alternative embodiment of the button device.
Figure 5:
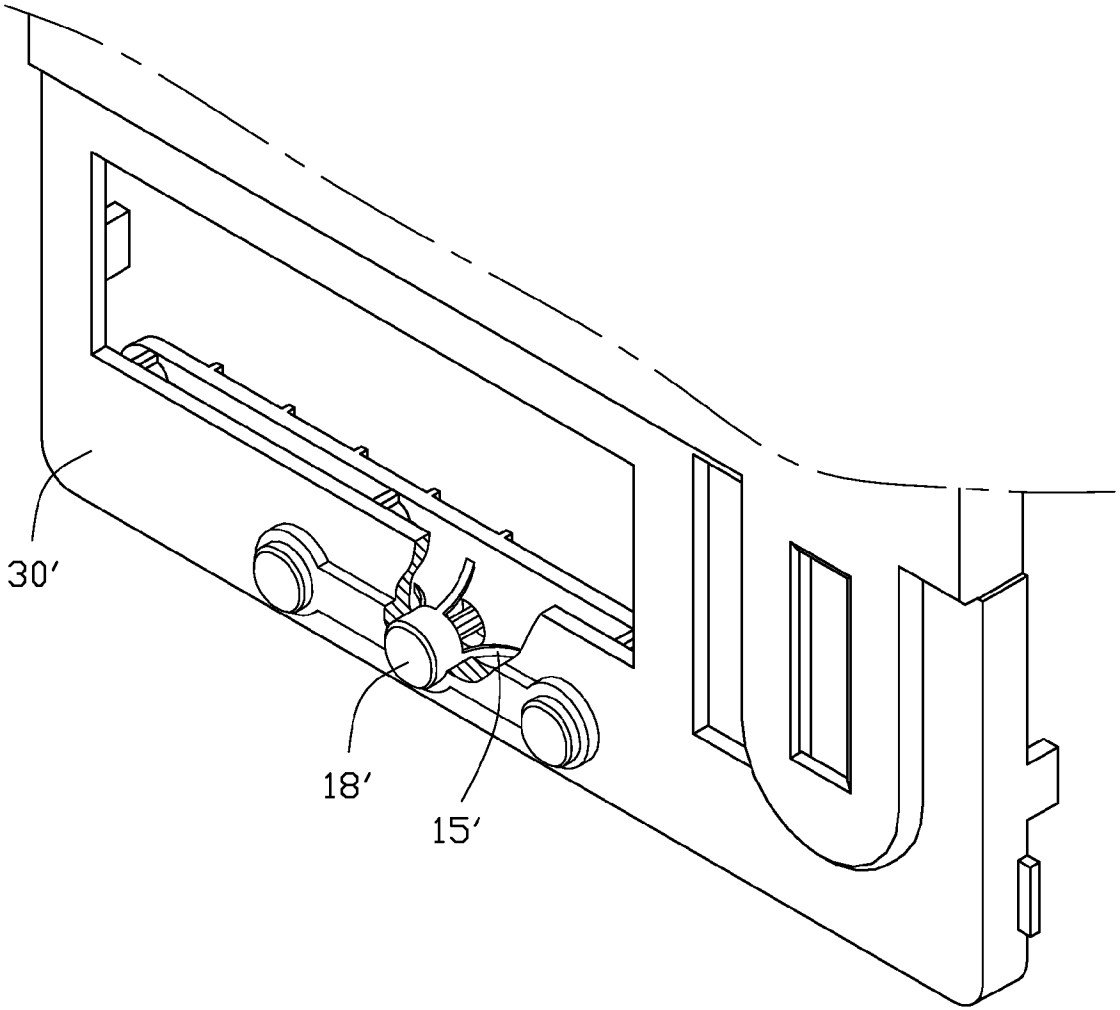
FIG. 5 is an assembled view of the alternative embodiment of the button device, showing the button device attached to the bezel.

Referring to FIG. 4, it shows an alternative embodiment of the button unit 17. In the alternative embodiment, the elastic member 15' is formed by a plurality of spaced elastic pins radially depending from the circumference of the cap 18' of the button unit 17', and the elastic member 15' is exposed in the air and allows air interchange therethrough. A diameter of the aperture in the bezel is smaller than the maximum diameter rounded by the pins of the elastic member 15'. Thereby, the elastic member 15' is interferentially inserted in the aperture. The button unit 17' is secured to the bezel, and the distal ends of the elastic pins abut against the base 11'.

While the present invention has been illustrated by the description of the preferred embodiments thereof, and while the preferred embodiments have been described in considerable detail, it is not intended to restrict or in any way limit the scope of the appended claims to such detail. Additional advantages and modifications within the spirit and scope of the present invention will readily appear to those skilled in the art. Therefore, the present invention is not limited to the specific details and illustrative examples shown and described.

We claim:

1. A button device for an electronic device, comprising:

a base configured for being secured to the electronic device; and at least one resilient button unit integrally formed with the base, the button unit comprising an elastic member extending from the base in a spiral pattern with space therein, an integral pressing part extending oppositely away from the button unit through the base for controlling a switch of the electronic device.

2. The button device as described in claim 1, wherein the button unit comprises a cap integrally formed with a top end of the spiral elastic member and supported thereon.

3. The button device as described in claim 2, wherein the pressing part of the button unit is a post extending from a bottom of the cap.

4. The button device as described in claim 1, wherein at least one through hole is defined in the base for the pressing part of the button unit protruding through.

5. The button device as described in claim 1, wherein a plurality of securing holes is defined in the base for securing the base to the electronic device.

6. A button device comprising:

a bezel of an electronic device, an aperture defined in the bezel;

a base secured to the bezel of the electronic device, a through hole defined in the base; and a button unit disposed between the base and the bezel, comprising a cap extending through the aperture in the bezel and a plurality of arcuate elastic pins radially depending around and away from the cap, an edge of the aperture in the bezel abutting on the arcuate elastic pins to retain the button unit between the base and the bezel and force free ends of the arcuate elastic pins to abut against the base, a pressing part protruding through the through hole in the base integrally extending from the cap, wherein the button unit is pressed to force the free ends of the elastic pins to deform radially away from each other.

7. The button device as described in claim 6, wherein the pressing part is a post extending from an inner side of the cap, and the elastic member surrounds the pressing part.

8. The button device as described in claim 6, wherein the elastic pins abut on the base and surround the through hole in the base.

9. The button device as described in claim 6, wherein the elastic pins are spaced from one another.

* * * * *